US012214293B2

(12) United States Patent
Chen

(10) Patent No.: US 12,214,293 B2
(45) Date of Patent: Feb. 4, 2025

(54) TRANSFORMABLE TOY

(71) Applicants: ALPHA GROUP CO., LTD., Guangdong (CN); GUANGZHOU ALPHA CULTURE COMMUNICATIONS CO., LTD., Guangdong (CN)

(72) Inventor: Zefeng Chen, Guangdong (CN)

(73) Assignees: ALPHA GROUP CO., LTD., Guangdong (CN); GUANGZHOU ALPHA CULTURE COMMUNICATIONS CO., LTD., Guangdong (CN)

( * ) Notice: Subject to any disclaimer, the term of this patent is extended or adjusted under 35 U.S.C. 154(b) by 228 days.

(21) Appl. No.: 18/161,062

(22) Filed: Jan. 29, 2023

(65) Prior Publication Data

US 2024/0252943 A1 Aug. 1, 2024

(51) Int. Cl.

| | |
|---|---|
| ***A63H 17/00*** | (2006.01) |
| ***A63H 3/36*** | (2006.01) |
| ***A63H 17/02*** | (2006.01) |
| ***A63H 17/26*** | (2006.01) |
| ***A63H 33/00*** | (2006.01) |

(52) U.S. Cl.

CPC ..... *A63H 33/003* (2013.01); *A63H 3/36* (2013.01); *A63H 17/004* (2013.01); *A63H 17/02* (2013.01); *A63H 17/264* (2013.01)

(58) Field of Classification Search

CPC ..... A63H 17/00; A63H 17/004; A63H 17/02; A63H 17/26; A63H 33/003

See application file for complete search history.

(56) References Cited

U.S. PATENT DOCUMENTS

| | | | | |
|---|---|---|---|---|
| 5,129,851 | A * | 7/1992 | Villanueva | A44C 9/00 446/469 |
| 5,609,510 | A * | 3/1997 | Stubenfoll | A63H 17/26 446/470 |
| 6,394,876 | B1 * | 5/2002 | Ishimoto | A63H 17/004 446/469 |
| 7,033,241 | B2 * | 4/2006 | Lee | A63H 17/004 446/470 |
| 7,568,965 | B2 * | 8/2009 | Toriyama | A63H 17/02 446/376 |
| 8,066,542 | B2 * | 11/2011 | Ejima | A63H 33/003 446/376 |
| 8,348,715 | B2 * | 1/2013 | Miyake | A63H 17/02 446/321 |
| 9,579,583 | B2 * | 2/2017 | Sheltman | A63H 17/008 |

(Continued)

*Primary Examiner* — John A Ricci

(57) ABSTRACT

Provided is a transformable toy including a vehicle body having a lower surface provided with wheels and an upper surface opposite to the lower surface, and a straight-running driving assembly disposed in the vehicle body. The vehicle body includes at least two sections, a rotation driving assembly is disposed between two adjacent sections of the vehicle body and configured to drive the at least two sections of the vehicle body to rotate relative to each other to transform the vehicle body; when the at least two sections of the vehicle body rotate relative to each other into a transformed state, the vehicle body is in a rollable shape; when the at least two sections of the vehicle body rotate relative to each other into an unfolded state, the vehicle body runs under the action of the straight-running driving assembly.

18 Claims, 5 Drawing Sheets

(56) References Cited

U.S. PATENT DOCUMENTS

| | | | | |
|---|---|---|---|---|
| 10,207,194 | B2 * | 2/2019 | Sheltman | A63H 17/26 |
| 10,773,177 | B2 * | 9/2020 | Ishida | A63H 3/04 |
| 11,883,760 | B2 * | 1/2024 | Choi | A63H 33/003 |
| 2017/0189821 | A1 * | 7/2017 | Cai | A63H 29/22 |
| 2024/0050867 | A1 * | 2/2024 | Lee | A63H 33/26 |

* cited by examiner

TRANSFORMABLE TOY

TECHNICAL FIELD

The present disclosure relates to the field of toy technologies, and more particularly, to a transformable toy.

BACKGROUND

Most existing remote controlled toy vehicles may only realize remote controlled running or steering. There is only a single playable mode and has less interestingness, so a user usually loses interest after playing it for a period of time Therefore, it is necessary to design a transformable toy capable of realizing another new playable mode after being transformed.

SUMMARY

An objective of the present disclosure is to overcome the shortcomings of the related art, and provide a transformable toy capable of realizing another new playable mode after being transformed.

The technical solution of the present disclosure is to provide a transformable toy. The transformable toy includes a vehicle body and a straight-running driving assembly disposed in the vehicle body. The vehicle body has a lower surface provided with wheels and an upper surface opposite to the lower surface. The vehicle body includes at least two sections. A rotation driving assembly is disposed between two adjacent sections of the vehicle body and configured to drive the at least two sections of the vehicle body to rotate relative to each other to transform the vehicle body. When the at least two sections of the vehicle body rotate relative to each other into a transformed state, the vehicle body is in a rollable shape. When the at least two sections of the vehicle body rotate relative to each other into an unfolded state, the vehicle body runs under an action of the straight-running driving assembly.

Further, the vehicle body includes three sections, which are successively a head portion, a body portion, and a tail portion. The rotation driving assembly is disposed in the body portion and configured to drive the head portion and the tail portion to rotate relative to the body portion. The straight-running driving assembly is disposed in the head portion or the tail portion.

Further, the upper surface of the vehicle body is arc-shaped, or an arc-shaped strip is disposed on the upper surface of the vehicle body, to enable the vehicle body to be in the rollable shape in the transformed state.

Further, the vehicle body has a protruding support portion on at least one side surface of at least one section thereof. When one side of the vehicle body in the transformed state topples over to a ground and the vehicle body is unfolded, the support portion enables the lower surface of the unfolded vehicle body to face towards the ground.

Further, the support portion extends out towards an outside of the vehicle body, and an outer end surface of the support portion forms an arc-shaped bevel edge inclined inwards from top to bottom in a vertical direction of the vehicle body.

Further, a front end and/or a rear end of the vehicle body is provided with a trundle.

Further, an arc plate is disposed between the vehicle bodies of adjacent sections and located on the upper surface of the vehicle body. One end of the arc plate is pivotally connected to one section of the vehicle body, and another end of the arc plate is slidable along an upper surface of another adjacent section of the vehicle body during transformation.

Further, one arc plate has an arc-shaped convex ridge disposed thereon. A center of gravity of the vehicle body in the transformed state is adjusted in such a manner that when the vehicle body stops rolling, the arc-shaped convex ridge is in contact with the ground and enables the vehicle body to topple over towards one side.

Further, the transformable toy further includes a steering assembly. The steering assembly includes a steering motor, a second gear set, a steering gear, a connecting rod, a steering wheel, and a torsional spring. The steering motor is configured to drive the steering gear through the second gear set. The steering gear is fixedly connected to the steering wheel through the connecting rod. The connecting rod is further connected to the torsional spring. When the steering motor is not in operation, the torsional spring is in a natural state.

Further, adjacent sections of the vehicle bodies are pivotally connected to each other. The rotation driving assembly includes a rotating motor and a gear set configured to be driven by the rotating motor. One end of the gear set is fixedly connected to a first fixing portion, and the first fixing portion is fixedly connected to one section of the vehicle body. Another end of the gear set is fixedly connected to a second fixing portion, and the second fixing portion is fixedly connected to another section of the vehicle body.

The present disclosure further provides a transformable toy. The transformable toy includes a vehicle body and a straight-running driving assembly disposed in the vehicle body. The vehicle body has a lower surface provided with wheels and an upper surface opposite to the lower surface. The vehicle body includes at least two sections. A rotation driving assembly is disposed between two adjacent sections of the vehicle body and configured to drive the at least two sections of the vehicle body to rotate relative to each other to transform the vehicle body. When the at least two sections of the vehicle body rotate relative to each other into a transformed state, the vehicle body is in a rollable shape. When the at least two sections of the vehicle body rotate relative to each other into an unfolded state, the vehicle body runs under an action of the straight-running driving assembly. The vehicle body has an arc-shaped convex ridge disposed on the upper surface thereof. A center of gravity of the vehicle body in the transformed state is adjusted in such a manner that when the vehicle body stops rolling, the arc-shaped convex ridge is in contact with a ground and enables the vehicle body to topple over towards one side.

Further, the vehicle body has a protruding support portion on at least one side surface of at least one section thereof, and when one side of the vehicle body topples over to the ground and the vehicle body is unfolded, the support portion enables the lower surface of the unfolded vehicle body to face towards the ground.

Further, the support portion extends out towards an outside of the vehicle body, and an outer end surface of the support portion forms an arc-shaped bevel edge inclined inwards from top to bottom in a vertical direction of the vehicle body.

By adopting the above technical solutions, the following beneficial effects are achieved:

In the present disclosure, when the vehicle body runs on the ground, the rotating assembly can control the vehicle body to rotate into the transformed state, and the vehicle body is in the rollable shape and rolls under the action of inertia. After the rolling stops, when the rotating assembly controls the vehicle body to rotate into the unfolded state, the vehicle body runs under the action of the driving assembly. After the vehicle body of the present disclosure is transformed, a new playable mode is formed, which increases playability and interestingness of the transformable toy.

BRIEF DESCRIPTION OF THE DRAWINGS

Referring to the accompanying drawings, the disclosed content of the present disclosure will become more understandable. It should be understood that these drawings are merely used for illustrative purposes, and are not intended to limit the scope of the present disclosure. In the drawings.

REFERENCE NUMERALS

1—head portion; 2—body portion; 3—tail portion;
4—straight-running driving assembly; 5—rotation driving assembly; 6—trundle
7—arc plate; 8—steering assembly; 11—arc-shaped strip;
21—arc-shaped strip; 22—support portion; 31—arc-shaped strip;
41—driving motor; 42—first gear set; 43—fixed gear;
44—shaft rod; 45—driving wheel;
51—rotating motor; 52—third gear set; 53—fourth gear set;
54—first rotating gear; 55—second rotating gear; 56—first rotating shaft;
57—second rotating shaft; 58—first fixing portion; 59—second fixing portion;
71—arc-shaped convex ridge; 81—steering motor; 82—second gear set;
83—steering gear; 84—connecting rod; 85—steering wheel;
86—torsional spring; 221—arc-shaped bevel edge

DETAILED DESCRIPTION

Specific implementations of the present disclosure are further described below with reference to the accompanying drawings.

It is easy to understand that, according to the technical solutions of the present disclosure, those of ordinary skill in the art may replace various structural manners and implementations with each other without departing from the ideas of the present disclosure. Therefore, the following specific implementations and the accompanying drawings are merely exemplary descriptions of the technical solutions of the present disclosure, and should not be regarded as all of the present disclosure, or a restriction or limitation on the technical solutions of the present disclosure.

Orientation terms such as over, below, left, right, front, rear, front, back, top, bottom, etc., which are referred to or may be mentioned in this specification, are defined with respect to the configuration shown in the accompanying drawings, and they are relative concepts and may change in accordance with different locations thereof and different use of states. Therefore, these or other orientation terms should not be explained as limiting terms.

In the present disclosure, a transformable toy includes a vehicle body, and a straight-running driving assembly 4 disposed in the vehicle body. The vehicle body has a lower surface provided with wheels and an upper surface opposite to the lower surface. The vehicle body includes at least two sections. A rotation driving assembly 5 is disposed between two adjacent sections of the vehicle body and configured to drive at least two sections of the vehicle body to rotate relative to each other to transform the vehicle body.

When the at least two sections of the vehicle body rotate relative to each other into a transformed state, the vehicle body is in a rollable shape.

When the at least two sections of the vehicle body rotate into an unfolded state, the vehicle body runs under the action of the straight-running driving assembly 4.

Figure 1:
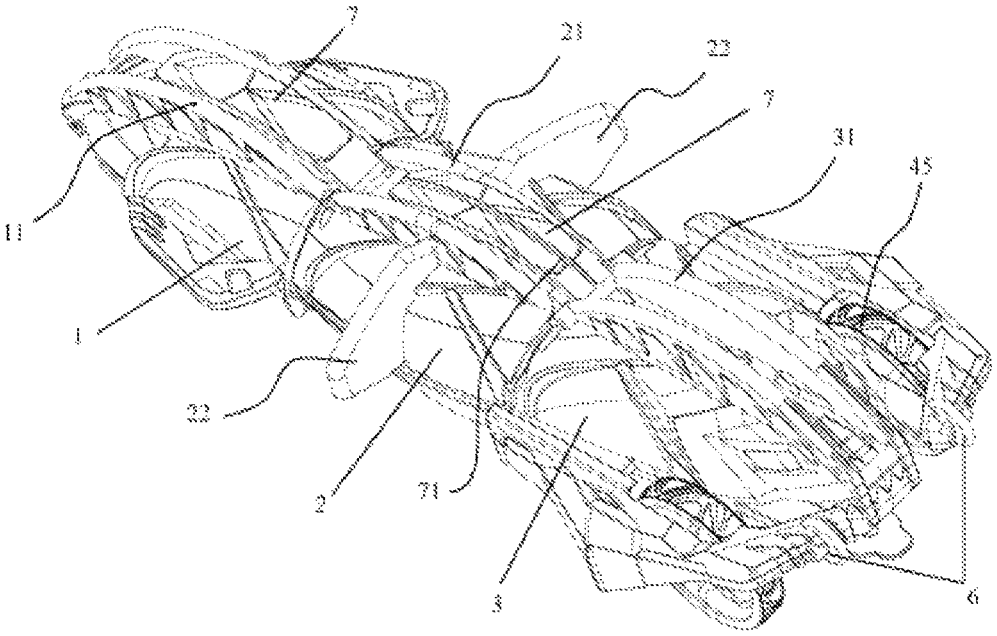
FIG. 1 is a perspective view of a transformable toy in an unfolded state according to an embodiment of the present disclosure.
Figure 2:
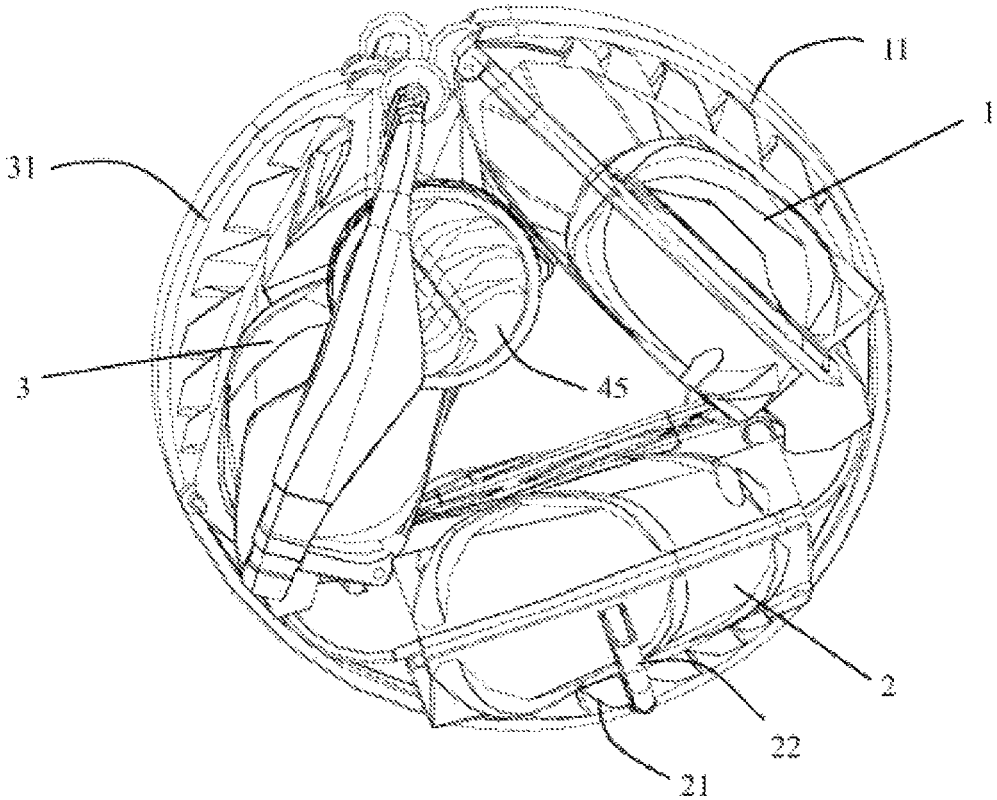
FIG. 2 is a side view of a transformable toy in a transformed state according to an embodiment of the present disclosure.
Figure 3:
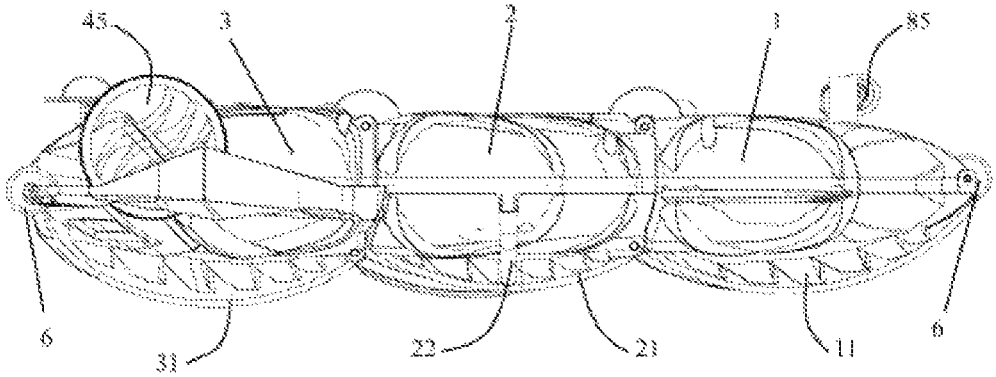
FIG. 3 is a side view of a transformable toy in an unfolded state according to an embodiment of the present disclosure.

In this embodiment, as illustrated in FIG. 1 to FIG. 3, the vehicle body includes three sections, which are successively a head portion 1, a body portion 2, and a tail portion 3. The rotation driving assembly 5 (see FIG. 9) is disposed in the body portion 2 and configured to drive the head portion 1 and the tail portion 3 to rotate relative to the body portion 2. The straight-running driving assembly 4 (see FIG. 6) is disposed at the head portion 1 or the tail portion 3.

As illustrated in FIG. 1, the head portion 1, the body portion 2, and the tail portion 3 are successively arranged from left to right. The head portion 1 is equivalent to a vehicle head. The tail portion 3 is equivalent to a vehicle tail. The sections of the vehicle body are pivotally connected to each other through a rotating shaft. The rotation driving assembly 5 drives the head portion 1 and the tail portion 3 to rotate relative to each other. FIG. 1 is an unfolded state of the vehicle body. In this case, the straight-running driving assembly 4 may drive the entire vehicle body to run, i.e., move forwards or backwards, to realize a playable mode of the general transformable toy.

As illustrated in FIG. 2, when the rotation driving assembly 5 drives the head portion 1 and the tail portion 3 to rotate towards each other until the head portion 1 docks with the tail portion 3 and the vehicle body is formed as a roller-shaped or wheel-shaped structure with a circular outer contour. After rotating to be transformed, the vehicle body rolls under the action of inertia until the rolling stops. Then, by controlling the rotation driving assembly 5, the vehicle body is unfolded and returns to the unfolded state in which the vehicle body can normally run again.

According to this embodiment, by changing the unfolded state and the transformed state of the vehicle body, switching of different playable modes is achieved, which increases playability and interestingness of the transformable toy.

In this embodiment, the straight-running driving assembly 4 is mounted in the tail portion 3 and drives the vehicle body to run in a back drive manner.

In an embodiment, the straight-running driving assembly 4 may alternatively be mounted in the head portion 1 to drive the vehicle body to run in a front drive manner.

In an embodiment, the vehicle body may have only two sections, for example, only the head portion and the tail portion, without the body portion. A rotating assembly is mounted in the head portion or the tail portion. The head portion and the tail portion rotate relative to each other to form the wheel-shaped structure.

In an embodiment, the vehicle body may further include more than three sections.

Further, as illustrated in FIG. 1 and FIG. 2, arc-shaped strips 11, 21, 31 are disposed on upper surfaces of the three sections of the vehicle body. Here, two arc-shaped strips 11 parallel to each other are disposed on an upper surface of the head portion 1. Two arc-shaped strips 21 parallel to each other are disposed on an upper surface of the body portion 2. Two arc-shaped strips 31 parallel to each other are disposed on an upper surface of the tail portion 3.

In the transformed state, three groups of arc-shaped strips 11, 21, 31 are formed on a periphery of the vehicle body in a rollable shape to form a circular outer contour, which is beneficial to rolling of the vehicle body after being folded.

In an embodiment, the arc-shaped strip may not be provided, but an upper surface of each section of the vehicle body is formed in an arc shape. For example, the upper surface may be formed as a convex portion with an arc surface, and the convex portions form a wheel-shaped outer contour after being folded.

Figure 4:
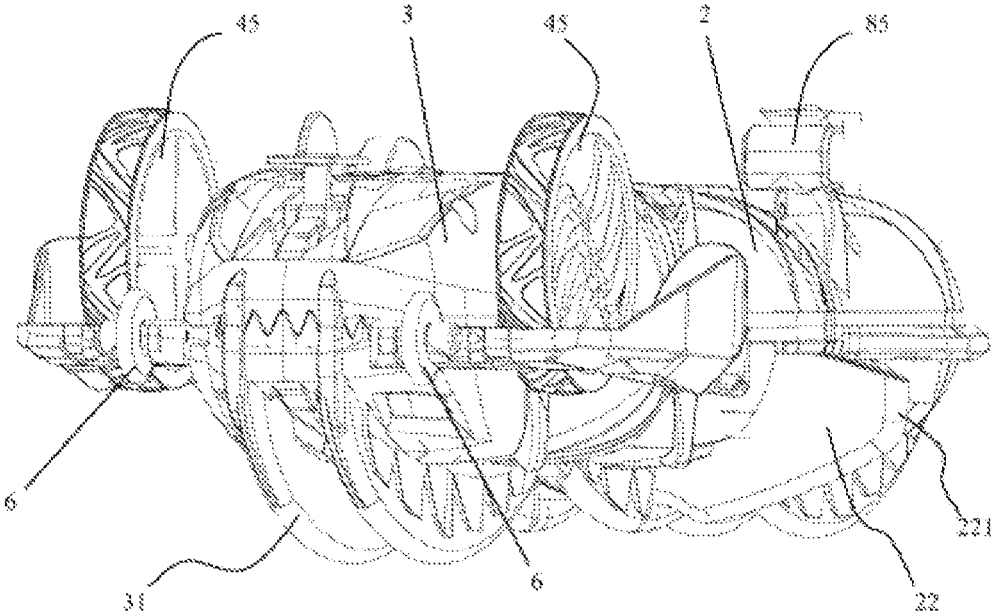
FIG. 4 is a perspective view of a transformable toy in an unfolded state according to an embodiment of the present disclosure.

In the embodiment, as illustrated in FIG. 1 and FIG. 4, each of the left and right side faces of the body portion 2 of the vehicle body is provided with a support portion 22 protruding and extending out towards the outside of the vehicle body. When one side of the vehicle body in the transformed state topples over to the ground and the vehicle body is unfolded, the support portion 22 enables the lower surface of the unfolded vehicle body to face towards the ground.

Since the arc-shaped strips enable the transformable toy to roll on the ground under the action of the inertia, after a speed thereof is reduced, the vehicle body may not be able to stand on the ground due to an unstable center of gravity and topples over towards one side. After the vehicle body topples over, the rotation driving assembly 5 is activated to enable the vehicle body to be in the unfolded state. Since two sides of the body portion 2 are provided with the support portions 22 protruding to the outside of the body portion, when the vehicle body topples over towards one side and unfolded, under the action of the support portion 22, a lower surface of the unfolded toy vehicle faces towards the ground, and a driving wheel 45 is in contact with the ground, in such a manner that the toy vehicle can still be remotely controlled to continue playing, and a case where the upper surface of the vehicle body is in contact with the ground and the toy vehicle cannot be played is avoided.

Further, as illustrated in FIG. 4, the support portion 22 is disposed on an upper half section of a side surface of the body portion 2. The support portion 22 extends out towards the outside of the vehicle body. An outer end surface of the support portion 22 forms an arc-shaped bevel edge inclined inwards from top to bottom in a vertical direction of the vehicle body.

Since the arc-shaped bevel edge 221 has a certain radian and is inclined inwards from top to bottom. When the vehicle body topples over to the ground, the arc-shaped bevel edge 221 is supported on and in contact with the ground. Since an inclination angle exists, when the vehicle body is unfolded, the lower surface of the unfolded vehicle body faces towards the ground.

In an embodiment, the support portions 22 may be mounted on left and right side faces of the head portion 1 or the tail portion, or on one of the side faces.

In an embodiment, the support portion 22 may be in other shapes or of other structures, or may be mounted at other positions, which is not limited as long as the lower surface of the unfolded toy vehicle face towards the ground under the action of the support portion 22 and the driving wheel 45 is in contact with the ground, when the vehicle body topples over toward one side to be unfolded.

Further, as illustrated in FIG. 1 and FIG. 3, a front end and/or a rear end of the vehicle body has a trundle 6.

In some embodiments, a front end of the head portion 1 has a trundle 6. A rear end of the tail portion 3 has two trundles 6. When the toy vehicle rolls on the ground after being folded, the trundles 6 facilitate rolling of the toy vehicle, which may extend time of rolling on the ground.

Figure 5:
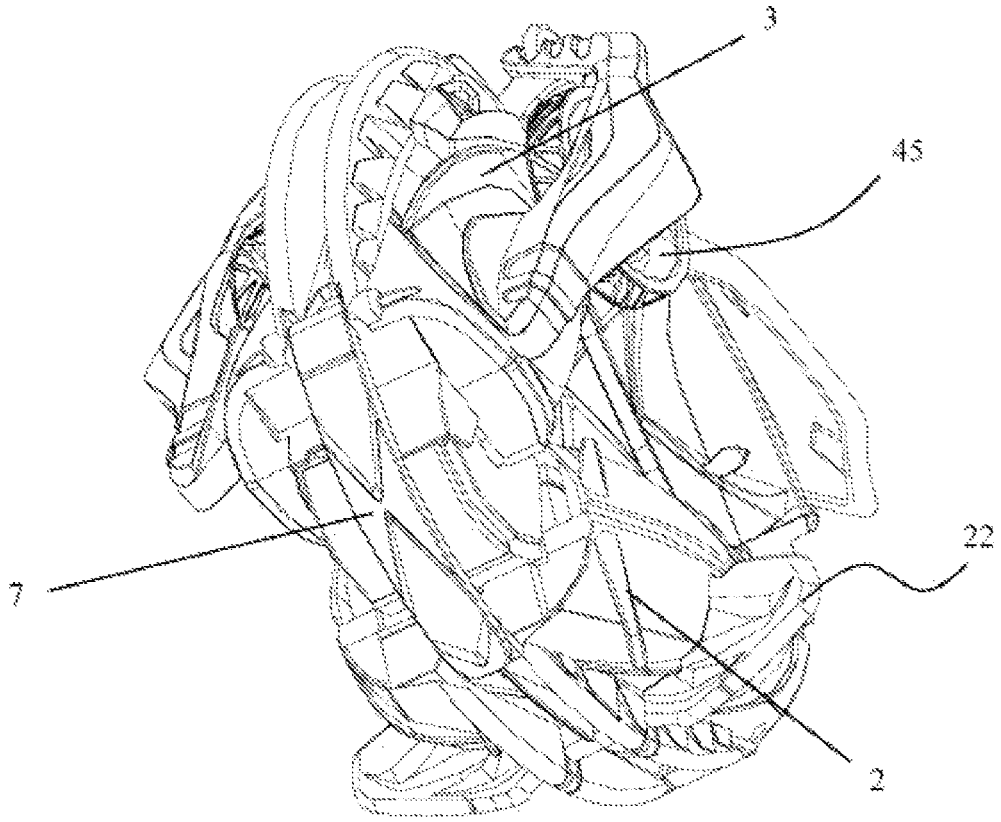
FIG. 5 is a perspective view of a transformable toy in a transformed state according to an embodiment of the present disclosure.

Further, as illustrated in FIG. 1 and FIG. 5, an arc plate 7 is disposed between adjacent sections of the vehicle body and located on the upper surface of the vehicle body. One end of the arc plate 7 is pivotally connected to one section of the vehicle body. Another end of the arc plate 7 is slidable along an upper surface of another adjacent section of the vehicle body during transformation, and is configured to shield a gap between the adjacent sections of the vehicle body.

In this embodiment, two arc plates 7 are provided. One of the two arc plates is located on the upper surface of the head portion 1, and the other arc plate is located on the upper surface of the body portion 2. The arc plate 7 is accommodated between two arc-shaped strips 11, 21 parallel to each other in the unfolded state.

Here, one end of the arc plate 7 on the head portion 1 is pivotally connected to the body portion 2, and another end of the arc plate 7 on the head portion 1 is a free end. In the unfolded state, a main body and the free end of the arc plate 7 are located on the upper surface of the head portion 1. In the transformed state, the head portion 1 rotates downwards below the vehicle body. A gap is formed between the head portion 1 and a housing of the body portion 2 at a joint thereof. In this case, the free end of the arc plate 7 slides along the upper surface of the head portion 1, and the arc plate 7 functions to shield the gap between the head portion 1 and the housing of the body portion 2.

Similarly, one end of the arc plate 7 on the body portion 2 is pivotally connected to the tail portion 3, and another end of the arc plate 7 on the body portion 2 is a free end. In the unfolded state, a main body and the free end of the arc plate 7 are located on the upper surface of the body portion 2. In the transformed state, the tail portion 3 rotates downwards below the vehicle body. A gap is formed between the tail portion 3 and the housing of the body portion 2 at a joint thereof. In this case, the free end of the arc plate 7 slides along the upper surface of the body portion 2, and the arc plate 7 functions to shield the gap between the tail portion 3 and the housing of the body portion 2.

The arc plate 7 on the body portion 2 has an arc-shaped convex ridge 71 disposed thereon. When a center of gravity of the vehicle body in the transformed state is adjusted in such a manner that when the vehicle body stops rolling, the arc-shaped convex ridge is in contact with the ground and enables the vehicle body to topple over towards one side.

Once in the transformed state, the arc plate 7 slides out from between the two arc-shaped strips 11, 21, and the arc-shaped convex ridge 71 of the arc plate 7 is in contact with the ground during the rolling process. The arc-shaped convex ridge 71 is located on a center line of the arc plate 7, which facilitates smooth rolling of the vehicle body.

By adjusting differently weights of three sections of the toy, the center of gravity of the transformable toy is offset from a center of a circle of the wheel-shaped structure. When the transformable toy stops rolling, the transformable toy always stays at a position where the arc-shaped convex ridge 71 is in contact with the ground. Since the arc-shaped convex ridge 71 is an arc line in an extending direction of the arc plate 7, and a contact area between the arc-shaped convex ridge 71 and the ground is small, the center of gravity of the whole transformable toy is thus unstable. Therefore, when the transformable toy is in the transformed state, rollover occurs once the transformable toy stops rolling. After the rollover, the support portions 22 disposed on the two sides of the body portion 2 support the vehicle body, which enables the lower surface of the unfolded vehicle body to face towards the ground.

In an embodiment, the arc-shaped convex ridge may also be disposed on the arc plate 7 corresponding to the head portion 1, or disposed on upper surfaces of the arc-shaped strips 11, 21, 31. The arc-shaped convex ridge 71 may be on a center line in the extending direction of the arc plate 7, and may be at a position slightly offset from the center line.

Figure 6:
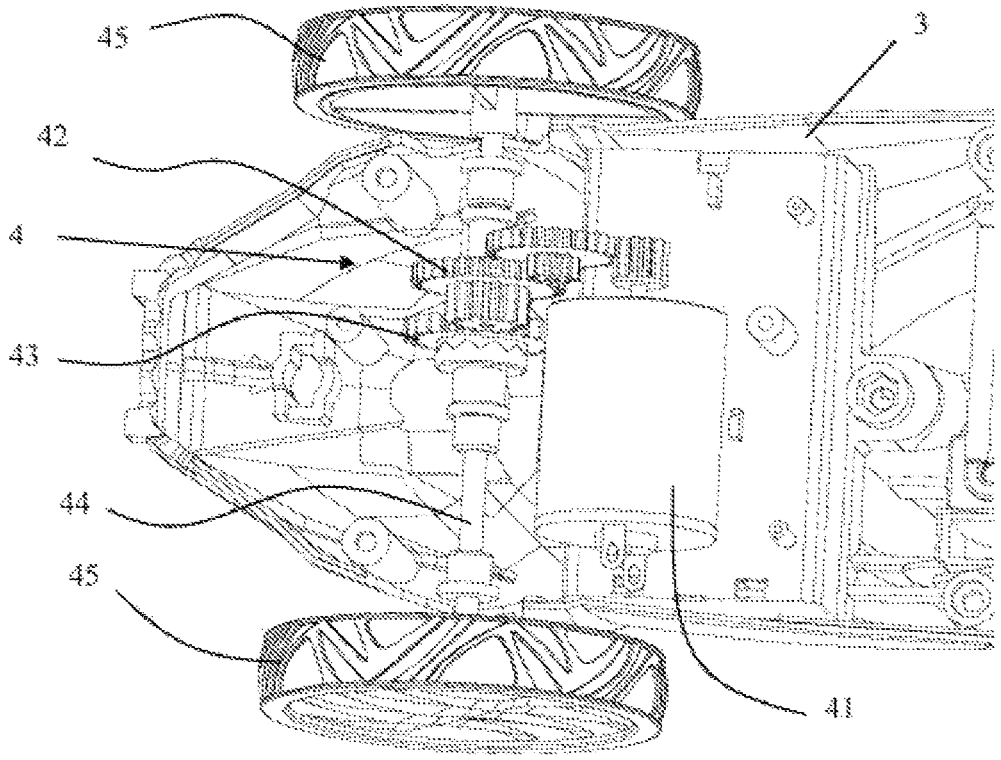
FIG. 6 is a perspective view of a driving assembly of a transformable toy according to an embodiment of the present disclosure.

In this embodiment, as illustrated in FIG. 6, the straight-running driving assembly 4 includes a driving motor 41, a first gear set 42, a fixed gear 43, a shaft rod 44, and two driving wheels 45. The driving motor 41 drives the fixed gear 43 to rotate through the first gear set 42. The shaft rod 44 passes through the fixed gear 43 and is fixedly connected to the fixed gear 43. Two ends of the shaft rod 44 are connected to the two driving wheels 45, respectively.

The driving wheel 45 is located outside a housing of the tail portion 3. Other components are mounted inside the housing of the tail portion 3. By controlling forward or backward rotation of the driving motor 41, the toy vehicle can be controlled to move forwards or backwards.

The first gear set 42 includes two transmission gears for transmitting power of the driving motor 41 and adjusting a rotation speed of the driving wheel 45.

In an embodiment, the first gear assembly 42 may further include transmission gears in other quantities, or the first gear assembly 42 is replaced with other transmission assemblies.

Figure 7:
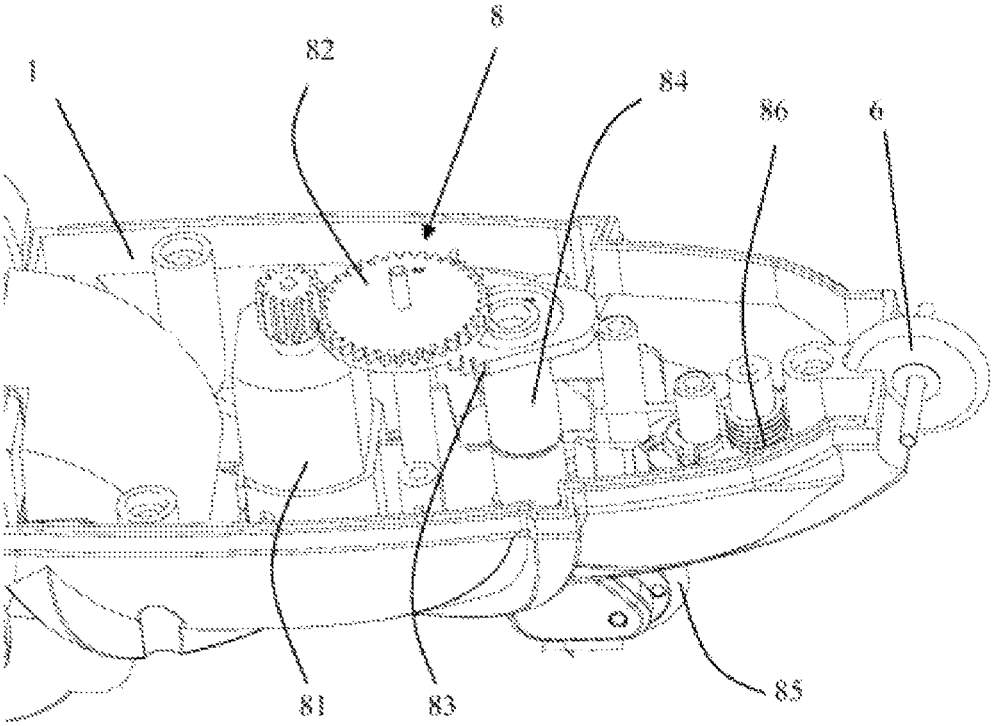
FIG. 7 is a perspective view of a steering assembly of a transformable toy according to an embodiment of the present disclosure.
Figure 8:
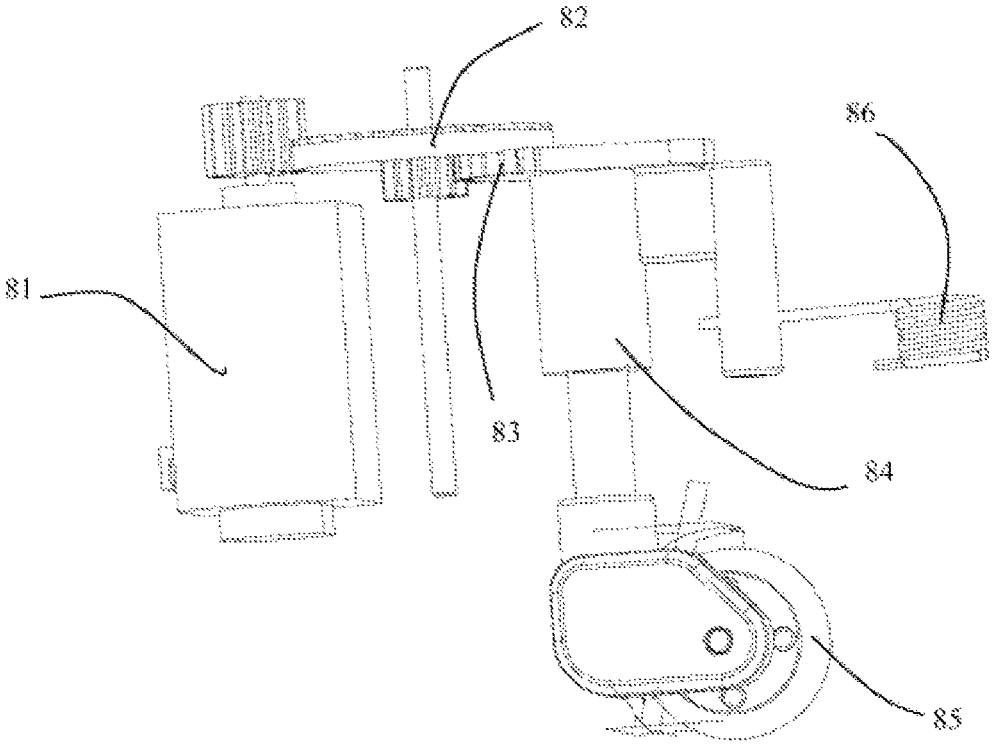
FIG. 8 is a side view of a steering assembly of a transformable toy according to an embodiment of the present disclosure.

Further, as illustrated in FIG. 7 to FIG. 8, the transformable toy further includes a steering assembly 8. The steering assembly 8 includes a steering motor 81, a second gear set 82, a steering gear 83, a connecting rod 84, a steering wheel 85, and a torsional spring 86. The steering motor 81 drives the steering gear 83 through the second gear set 82. The steering gear 83 is fixedly connected to the steering wheel 85 through the connecting rod 84. The connecting rod 84 is further connected to the torsional spring 86. When the steering motor 81 is not in operation, the torsional spring 85 is in a natural state.

The second gear assembly 82 includes two coaxial gears for transmitting power of the steering motor 81 and adjusting a rotation speed of the steering wheel 85. The steering gear 83 is fixed at a top end of the connecting rod 84. A bottom end of the connecting rod 84 extends out of a housing of the head portion 1 to be connected to the steering wheel 85. Only one steering wheel 85 is provided, and the steering wheel 85 may be an omni-directional wheel. The connecting rod 84 is also connected to the torsional spring 86.

When the steering motor 81 is not in operation, the torsional spring 86 is in the natural state. At this time, the toy vehicle may run straight under the action of the straight-running driving assembly 4.

When the steering motor 81 is in operation, the torsional spring 86 is twisted, and the steering assembly 8 and the straight-running driving assembly 4 act together, to enable the toy vehicle to be steered during running. When the steering motor 81 stops operating again, the steering wheel 85 returns to an initial position under the action of the torsional spring 86, i.e., a central axis of the steering wheel 85 is perpendicular to a length direction of the vehicle body, and the toy vehicle returns to a straight running state.

Both the straight-running driving assembly 4 and the steering assembly 8 operate when the vehicle body is in the unfolded state, to achieve a normal driving mode of the toy vehicle.

In this embodiment, the steering assembly 8 is disposed in the head portion 1. In an embodiment, the steering assembly 8 may also be disposed in the tail portion or the body portion 2, or in any section of the vehicle body.

In an embodiment, the steering assembly 8 may not be provided. In this case, when in the unfolded state, the toy vehicle can only run straight without steering.

Further, adjacent sections of the vehicle body are pivotally connected to each other. The rotation driving assembly 5 includes a rotating motor and a gear set driven by the rotating motor. One end of the gear set is fixedly connected to a first fixing portion, and the first fixing portion is fixedly connected to one section of the vehicle body. Another end of the gear set is fixedly connected to a second fixing portion, and the second fixing portion is fixedly connected to another section of the vehicle body.

Figure 9:
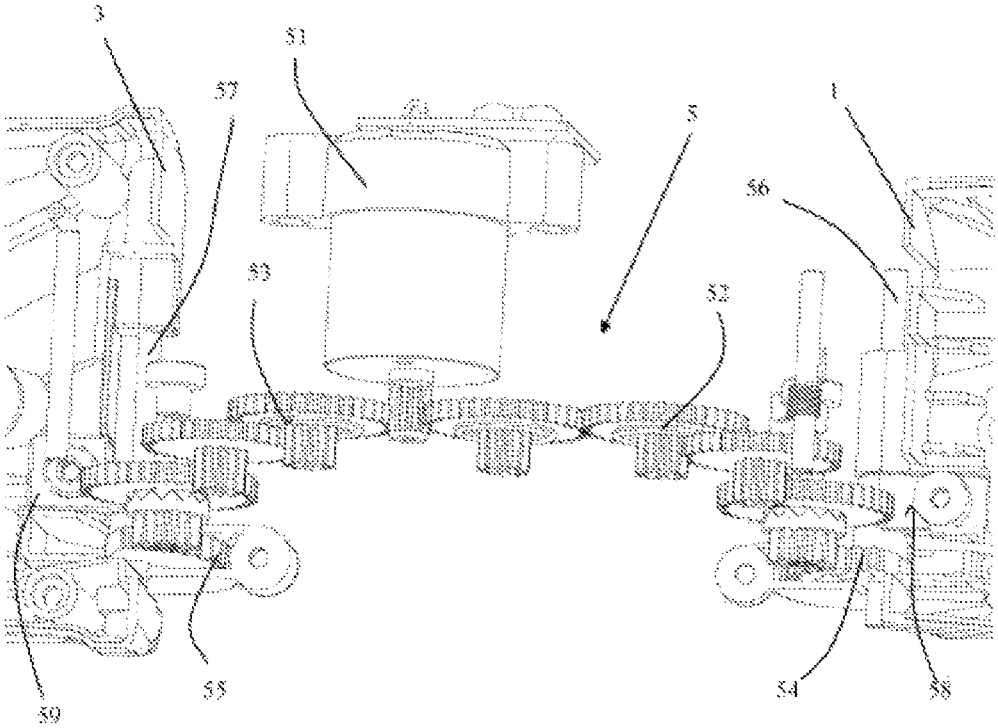
FIG. 9 is a perspective view of a rotating assembly of a transformable toy according to an embodiment of the present disclosure.

In some embodiments, as illustrated in FIG. 9, the rotation driving assembly 5 includes a rotating motor 51, a third gear set 52, a fourth gear set 53, a first rotating gear 54, a second rotating gear 55, a first rotating shaft 56, a second rotating shaft 57, a first fixing portion 58, and a second fixing portion 59.

The rotating motor 51 drives the third gear set 52 and the fourth gear set 53 respectively.

The third gear set 52 drives the first rotating gear 54 to rotate. The first rotating gear 54 is sleeved on the first rotating shaft 56. The first fixing portion 59 is fixedly connected to the first rotating gear 54 and extends towards one section of the vehicle body to be fixedly connected to the vehicle body.

The fourth gear set 53 drives the second rotating gear 55 to rotate. The second rotating gear 55 is sleeved on the second rotating shaft 57. The second fixing portion 59 is fixedly connected to the second rotating gear 55 and extends towards another section of the vehicle body to be fixedly connected to the vehicle body.

The rotating motor 51 is configured to simultaneously drive the head portion 1 and the tail portion 3 to rotate. Therefore, the rotating motor 51 simultaneously drives two groups of transmission assemblies. A left part of FIG. 9 is a transmission assembly of the tail portion 3, and a right part of FIG. 9 is a transmission assembly of the head portion 1.

The transmission assembly of the head portion 1 includes the third gear set 52, the first rotating gear 54, the first rotating shaft 56, and the first fixing portion 58. The third gear set 52 includes four transmission gears. The first rotating gear 54 is fixedly sleeved on the first rotating shaft 56. The first fixing portion 59 is fixedly connected to the first rotating gear 54 and extends towards the head portion 1 to be fixedly connected to the housing of the head portion 1.

When the rotating motor 51 rotates, the third gear set 52 drives the first rotating gear 54 to rotate, the first rotating gear 54 rotates on its own axis around the first rotating shaft 56, the first rotating gear 54 pulls the first fixing portion 58, and the first fixing portion 58 pulls the head portion 1 to rotate.

Similarly, the transmission assembly of the tail portion 3 includes the fourth gear set 53, the second rotating gear 55, the second rotating shaft 57, and the second fixing portion 59. An operation manner of this transmission assembly is the same as that of the above-mentioned transmission assembly.

When the rotating motor 51 is activated for the first time, the rotating motor 51 rotates in one direction. When the rotating motor 51 is activated again, the rotating motor 51 rotates in a reverse direction. Therefore, when the rotating motor 51 is activated, the toy vehicle changes from the unfolded shape to the rollable shape. When the rotating motor 51 is activated again, the toy changes from the rollable shape to the unfolded shape.

In this embodiment, the third gear set 52 and the fourth gear set 53 each include three transmission gears In an embodiment, the third gear set 52 and the fourth gear set 53 may further include transmission gears in other quantities, or other transmission assemblies are used to replace the third gear set 52 and the fourth gear set 53.

In an embodiment, when the vehicle body includes more than three sections, two or more rotation driving assemblies 5 may be provided. One of the rotation driving assemblies 5 may only drive one section of the vehicle body to rotate, or simultaneously drive two sections of the vehicle body to rotate.

The present disclosure has the following advantages:

Firstly, by changing the unfolded state and the transformed state of the vehicle body, switching of different playable modes is realized, and the playability and interestingness of the transformable toy are improved;

Secondly, by the cooperation of the center of gravity of the transformed vehicle body and the arc-shaped convex ridge, the vehicle body which stops rolling may topple over towards one side. Through the support portion, the lower surface of the vehicle body faces towards the ground and the driving wheel is in contact with the ground after the vehicle body topples over and is unfolded. Therefore, the vehicle body can still be controlled to continue playing after being unfolded.

The above is merely a principle and preferred embodiments of the present disclosure. It should be noted that, for those of ordinary skill in the art, several other variations can also be made based on the principle of the present disclosure, and these should also be regarded as falling into the scope of the present disclosure.

What is claimed is:

1. A transformable toy, comprising:

a vehicle body having a lower surface provided with wheels and an upper surface opposite to the lower surface; and a straight-running driving assembly disposed in the vehicle body, wherein the vehicle body comprises at least two sections, a rotation driving assembly being disposed between two adjacent sections of the vehicle body and configured to drive the at least two sections of the vehicle body to rotate relative to each other to transform the vehicle body, wherein:

when the at least two sections of the vehicle body rotate relative to each other into a transformed state, the vehicle body is in a rollable shape; and when the at least two sections of the vehicle body rotate relative to each other into an unfolded state, the vehicle body runs under an action of the straight-running driving assembly.

2. The transformable toy according to claim 1, wherein the vehicle body comprises three sections, which are successively a head portion, a body portion, and a tail portion, wherein:

the rotation driving assembly is disposed in the body portion and configured to drive the head portion and the tail portion to rotate relative to the body portion; and the straight-running driving assembly is disposed in the head portion or the tail portion.

3. The transformable toy according to claim 1, wherein the upper surface of the vehicle body is arc-shaped, or an arc-shaped strip is disposed on the upper surface of the vehicle body, to enable the vehicle body to be in the rollable shape in the transformed state.

4. The transformable toy according to claim 1, wherein the vehicle body has a protruding support portion on at least one side surface of at least one section thereof, wherein when one side of the vehicle body in the transformed state topples over to a ground and the vehicle body is unfolded, the support portion enables the lower surface of the unfolded vehicle body to face towards the ground.

5. The transformable toy according to claim 4, wherein the support portion extends out towards an outside of the vehicle body, and an outer end surface of the support portion forms an arc-shaped bevel edge inclined inwards from top to bottom in a vertical direction of the vehicle body.

6. The transformable toy according to claim 1, wherein a front end and/or a rear end of the vehicle body is provided with a trundle.

7. The transformable toy according to claim 1, wherein an arc plate is disposed between adjacent sections of the vehicle body and located on the upper surface of the vehicle body, one end of the arc plate being pivotally connected to one section of the vehicle body, and another end of the arc plate being slidable along an upper surface of another adjacent section of the vehicle body during transformation.

8. The transformable toy according to claim 7, wherein one arc plate has an arc-shaped convex ridge disposed thereon, and a center of gravity of the vehicle body in the transformed state is adjusted in such a manner that when the vehicle body stops rolling, the arc-shaped convex ridge is in contact with a ground and enables the vehicle body to topple over towards one side.

9. The transformable toy according to claim 1, further comprising a steering assembly, the steering assembly comprising a steering motor, a second gear set, a steering gear, a connecting rod, a steering wheel, and a torsional spring, wherein:

the steering motor is configured to drive the steering gear through the second gear set;

the steering gear is fixedly connected to the steering wheel through the connecting rod, and the connecting rod is further connected to the torsional spring; and when the steering motor is not in operation, the torsional spring is in a natural state.

10. The transformable toy according to claim 1, wherein:

adjacent sections of the vehicle body are pivotally connected to each other; and the rotation driving assembly comprises a rotating motor and a gear set configured to be driven by the rotating motor, wherein:

one end of the gear set is fixedly connected to a first fixing portion, the first fixing portion being fixedly connected to one section of the vehicle body, and another end of the gear set is fixedly connected to a second fixing portion, the second fixing portion being fixedly connected to another section of the vehicle body.

11. A transformable toy, comprising:

a vehicle body having a lower surface provided with wheels and an upper surface opposite to the lower surface; and a straight-running driving assembly disposed in the vehicle body, wherein the vehicle body comprises at least two sections, a rotation driving assembly being disposed between two adjacent sections of the vehicle body and configured to drive the at least two sections of the vehicle body to rotate relative to each other to transform the vehicle body, wherein:

when the at least two sections of the vehicle body rotate relative to each other into a transformed state, the vehicle body is in a rollable shape;

when the at least two sections of the vehicle body rotate relative to each other into an unfolded state, the vehicle body runs under an action of the straight-running driving assembly; and the vehicle body has an arc-shaped convex ridge disposed on the upper surface thereof, and a center of gravity of the vehicle body in the transformed state is adjusted in such a manner that when the vehicle body stops rolling, the arc-shaped convex ridge is in contact with a ground and enables the vehicle body to topple over towards one side.

12. The transformable toy according to claim 11, wherein the vehicle body has a protruding support portion on at least one side surface of at least one section thereof, and when one side of the vehicle body topples over to the ground and the vehicle body is unfolded, the support portion enables the lower surface of the unfolded vehicle body to face towards the ground.

13. The transformable toy according to claim 12, wherein the support portion extends out towards an outside of the vehicle body, and an outer end surface of the support portion forms an arc-shaped bevel edge inclined inwards from top to bottom in a vertical direction of the vehicle body.

14. The transformable toy according to claim 11, wherein the vehicle body comprises three sections, which are successively a head portion, a body portion, and a tail portion, wherein:

the rotation driving assembly is disposed in the body portion and configured to drive the head portion and the tail portion to rotate relative to the body portion; and the straight-running driving assembly is disposed in the head portion or the tail portion.

15. The transformable toy according to claim 11, wherein the upper surface of the vehicle body is arc-shaped, or an arc-shaped strip is disposed on the upper surface of the vehicle body, to enable the vehicle body to be in the rollable shape in the transformed state.

16. The transformable toy according to claim 11, wherein a front end and/or a rear end of the vehicle body is provided with a trundle.

17. The transformable toy according to claim 11, further comprising a steering assembly, the steering assembly comprising a steering motor, a second gear set, a steering gear, a connecting rod, a steering wheel, and a torsional spring, wherein:

the steering motor is configured to drive the steering gear through the second gear set;

the steering gear is fixedly connected to the steering wheel through the connecting rod, and the connecting rod is further connected to the torsional spring; and when the steering motor is not in operation, the torsional spring is in a natural state.

18. The transformable toy according to claim 11, wherein:

adjacent sections of the vehicle body are pivotally connected to each other; and the rotation driving assembly comprises a rotating motor and a gear set configured to be driven by the rotating motor, wherein:

one end of the gear set is fixedly connected to a first fixing portion, the first fixing portion being fixedly connected to one section of the vehicle body, and another end of the gear set is fixedly connected to a second fixing portion, the second fixing portion being fixedly connected to another section of the vehicle body.

* * * * *